US010138630B1

(12) United States Patent
Sarda

(10) Patent No.: US 10,138,630 B1
(45) Date of Patent: Nov. 27, 2018

(54) CONCRETE SHEARWALL AND ASSEMBLIES THEREOF, AND RELATED METHODS

(71) Applicant: Nandy Sarda, Las Vegas, NV (US)

(72) Inventor: Nandy Sarda, Las Vegas, NV (US)

( * ) Notice: Subject to any disclaimer, the term of this patent is extended or adjusted under 35 U.S.C. 154(b) by 0 days.

(21) Appl. No.: 15/666,980

(22) Filed: Aug. 2, 2017

(51) Int. Cl.

| | |
|---|---|
| ***E04B 1/16*** | (2006.01) |
| ***E04B 1/21*** | (2006.01) |
| ***E04B 1/92*** | (2006.01) |
| ***E04B 2/84*** | (2006.01) |
| ***E04C 3/34*** | (2006.01) |
| ***E04C 5/01*** | (2006.01) |
| ***E04G 11/06*** | (2006.01) |
| ***E04G 21/14*** | (2006.01) |

(52) U.S. Cl.
CPC ..... *E04B 2/84* (2013.01); *E04B 1/16* (2013.01); *E04B 1/21* (2013.01); *E04B 1/92* (2013.01); *E04C 3/34* (2013.01); *E04G 11/06* (2013.01); *E04G 21/14* (2013.01); *E04C 5/012* (2013.01)

(58) Field of Classification Search
CPC ..... E04B 2/84; E04B 1/16; E04B 1/92; E04B 1/21; E04G 21/14; E04G 11/06; E04G 13/028; E04G 13/02; E04G 13/021; E04G 13/025; E04G 13/023; E04G 13/026; E04C 5/012; E04C 3/34
See application file for complete search history.

(56) References Cited

U.S. PATENT DOCUMENTS

| | | | | | |
|---|---|---|---|---|---|
| 3,559,355 | A * | 2/1971 | Day | E04B 1/161 | 52/251 |
| 3,613,325 | A * | 10/1971 | Yee | E04B 1/20 | 52/236.8 |
| 3,992,844 | A * | 11/1976 | Gretter | E04B 2/68 | 52/424 |
| 4,060,948 | A * | 12/1977 | Brownlee | E04B 1/21 | 249/19 |
| 2001/0003234 | A1* | 6/2001 | Van Doren | E04L 31/165 | 52/251 |
| 2007/0193143 | A1* | 8/2007 | Antonic | E02D 27/02 | 52/241 |

(Continued)

FOREIGN PATENT DOCUMENTS

| | | | | |
|---|---|---|---|---|
| FR | 507913 | A * | 9/1920 | E04B 1/21 |
| FR | 1381843 | A * | 12/1964 | E04B 1/04 |

(Continued)

*Primary Examiner* — Phi D A
*Assistant Examiner* — Omar F Hijaz
(74) *Attorney, Agent, or Firm* — Allen Dyer Doppeit & Gilchrist, PA

(57) ABSTRACT

A shearwall assembly includes a first concrete and a second concrete column and a protrusion extending from a connection end of the respective concrete columns. Each protrusion has two side surfaces and a center surface. A pair of horizontal slab panels are positioned between the respective connecting ends of the first and second concrete columns and abutting the two side surfaces of the respective protrusions. A horizontal reinforcement extends from the center surface of the respective protrusions and between the respective trusses. Concrete is poured at a volume formed between the pair of horizontal slab panels and the first and second concrete columns.

6 Claims, 5 Drawing Sheets

(56) References Cited

U.S. PATENT DOCUMENTS

| | | | | |
|---|---|---|---|---|
| 2009/0120025 | A1* | 5/2009 | Sezen | E04C 3/20 52/340 |
| 2012/0047816 | A1* | 3/2012 | Zhong | E04L 31/161 52/11 |
| 2015/0330095 | A1* | 11/2015 | Kurosawa | E04C 5/012 52/741.3 |

FOREIGN PATENT DOCUMENTS

| | | | | |
|---|---|---|---|---|
| GB | 115457 A | * | 5/1918 | E04B 1/21 |
| GB | 812310 A | * | 4/1959 | E04B 1/21 |
| GB | 1017062 A | * | 1/1966 | E04B 1/165 |

* cited by examiner

CONCRETE SHEARWALL AND ASSEMBLIES THEREOF, AND RELATED METHODS

FIELD OF THE INVENTION

The present invention relates to concrete building elements, and more particularly, to shearwall assemblies made from such building elements and related methods of assembly.

BACKGROUND

In structural engineering, a shearwall is a structural element used to counter the effects of a lateral load acting on a structure. A shearwall is considered a major means of providing relatively stiff resistance to vertical and horizontal forces acting in its plane. Wind and seismic loads are the most common loads shearwalls are designed to carry. Under a combined loading condition, a shearwall can develop axial, shear, torsional and flexural strains, resulting in a complicated internal stress distribution, which can be transferred vertically to a building's foundation. A robust shearwall is therefore crucial for building construction. Some advances have been made in shearwall construction. However, further improvements are possible.

SUMMARY OF THE INVENTION

In view of the foregoing, it is an object of the present invention to provide improved shearwalls, assemblies thereof and related methods.

According to an embodiment of the present invention, a shearwall assembly includes a first concrete column, a second concrete column, and a protrusion extending from a connection end of the respective concrete columns. Each protrusion has two side surfaces and a center surface. A pair of horizontal slab panels are positioned between the respective connection ends of the first and second concrete columns and abutting the two side surfaces of the respective protrusions. A horizontal reinforcement extends from the center surface of the respective protrusions and between the respective pair of slab panels. Concrete is poured into a volume formed between the pair of horizontal slab panels and the first and second concrete columns.

According to another embodiment of the present invention, a shearwall assembly includes a first and a second concrete column, and each column has a recess portion at a connection end of the respective column. Each recess portion has two side surfaces and a center surface. A pair of horizontal slab panels are positioned between the respective recess portion of the first and second concrete columns and abutting the two side surfaces of the respective recess portions. A horizontal reinforcement extends between the respective recess portions of the first and second concrete columns and between the respective pair of slab panels. Concrete is poured into a volume formed between the pair of horizontal slab panels and the first and second concrete columns.

According to a method of the present invention, a method for assembling a shearwall includes positioning a first and a second concrete column at a predetermined distance such that connection surfaces of the respective first and second columns oppose each other. A pair of horizontal slab panels are positioned between the first and second concrete columns by attaching the respective ends of the pair of horizontal slab panels to the respective connection surfaces on the first and second concrete columns such that a volume is formed between the pair of horizontal slab panels and the first and second concrete columns. Concrete is poured into a volume formed between the pair of horizontal slab panels and the first and second concrete columns.

These and other objects, aspects and advantages of the present invention will be better appreciated in view of the drawings and following detailed description of preferred embodiments.

DETAILED DESCRIPTION OF PREFERRED EMBODIMENTS

With reference to FIGS. 1-4, the structural elements of a shearwall and further features thereof are selected for exemplary and illustrative purposes, and it will be appreciated the present invention is not necessarily limited thereto.

Figure 1:
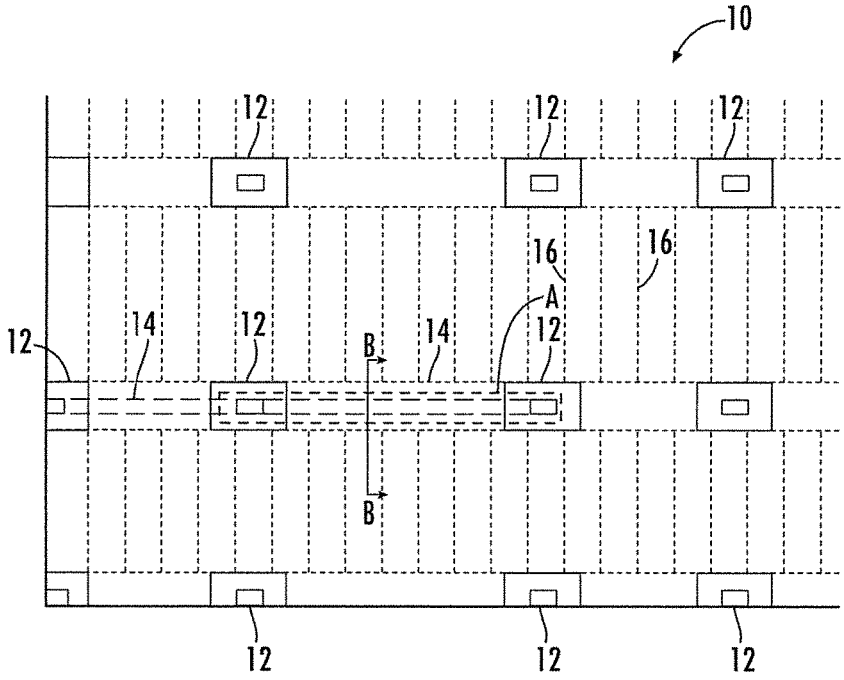
FIG. 1 is a top view of a concrete construction site, according to one embodiment of the present invention.

Referring to FIG. 1, a concrete construction site 10 include a plurality of concrete column assemblies 12 and one or more shearwalls 14 connected between the concrete column assemblies 12. A plurality of slabs 16 extend between concrete columns assemblies 12 in adjacent rows. For clarity of illustration, details of the concrete columns, column capitals and associated reinforcements extending therethrough are not shown in detail in FIG. 1.

Figure 2:
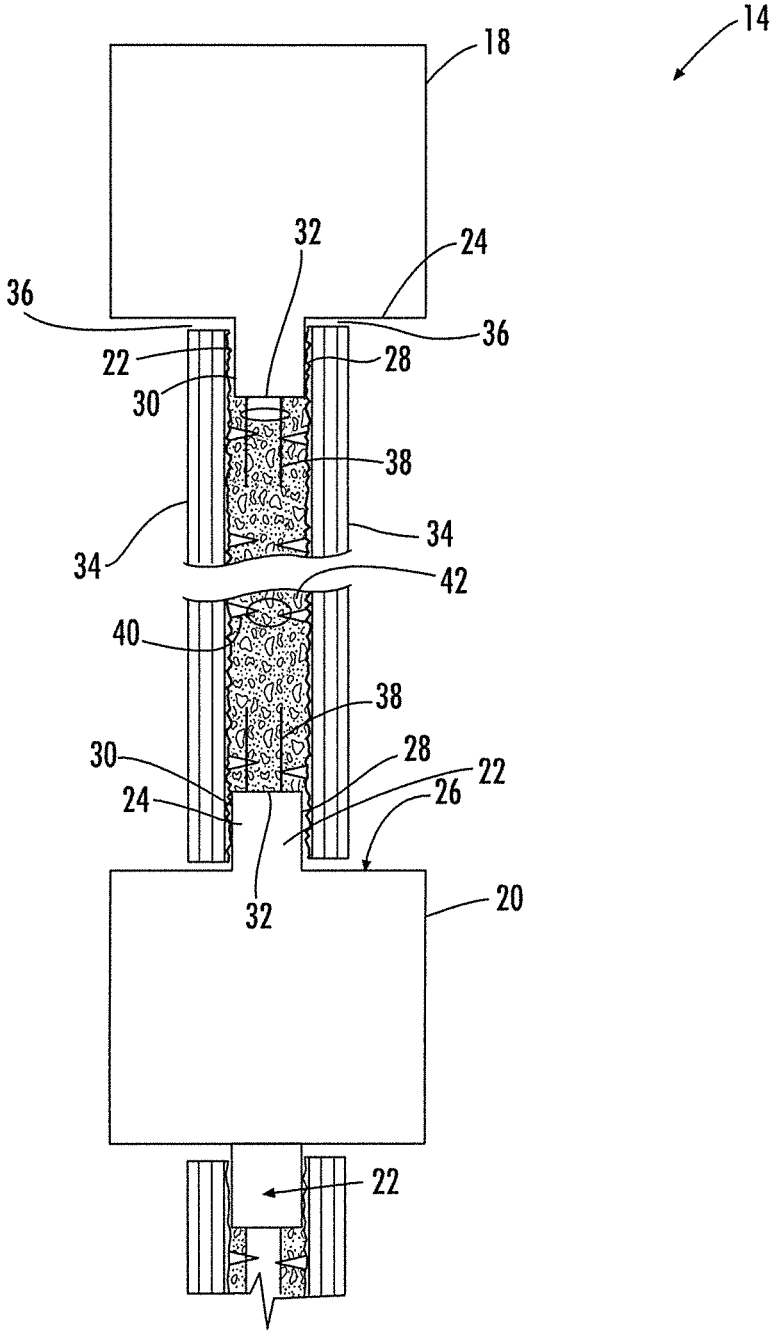
FIG. 2 is a top view of a shearwall assembly in the area A of FIG. 1, according to one embodiment of the present invention.

Referring to FIG. 2, according to an embodiment of the present invention, a shearwall assembly 14 is formed between a first concrete column 18 and a second concrete column 20. Each concrete column 18 or 20 has at least one protrusion 22 extending from the respective connection end 24 or 26. Each protrusion 22 has two side surfaces 28 and 30 and a center surface 32. A pair of horizontal slab panels 34 are positioned between the first and second concrete columns 18 and 20 and are attached to the two side surfaces 28 and 30 of the respective protrusions 22. In the depicted embodiment, there is a gap 36 between the end of the slab panels 34 and the respective connection ends 24 and 26 of the respective columns 18 and 20. The gaps 36 (e.g., 2 inches gap) can be established by placing wedges and filled by pouring concrete in place. A respective horizontal reinforcement 38 extends from the center surfaces 32 of the respective protrusions 22. A plurality of trusses 40 (e.g., girder trusses) are attached to inner surfaces of the pair of horizontal slab panels 34 such that the horizontal reinforcements 38 (e.g., dowel bars) are positioned between the respective trusses 40. Concrete is poured into a volume 42 between the pair of horizontal slab panels 34 and the first and second concrete columns 18 and 20, filling the gap 36. Gap 36 filled by concrete will ensure a robust connection between adjacent structures. The thickness of the shearwall 14 thus equals the width of the protrusion 22 plus the thickness of the concrete slabs panels 34. The thickness of the shearwall 14 can thus be adjusted by changing the width of the protrusion 22.

Figure 3:
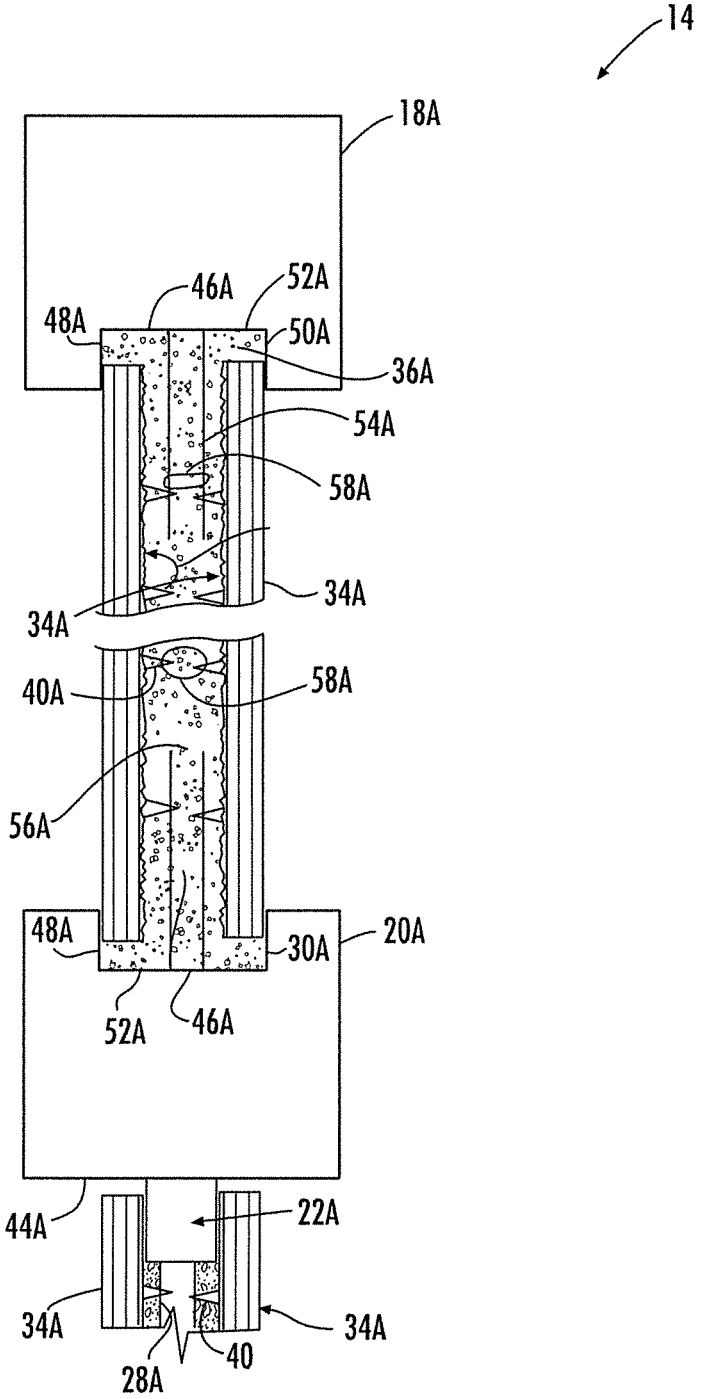
FIG. 3 is another top view of a shearwall assembly in the area A of FIG. 1, according to another embodiment of the present invention.

According to another embodiment of the present invention, referring to FIG. 3, the protrusion 22A is not permanently attached to a connection end 44A of the concrete column 20A. Rather, the protrusion 22A of a certain dimension (e.g., 2"×4" or 4"×4") is positioned adjacent to a connection end 44A of the column 20A. All other elements will be the same as previously described. Similar to FIG. 1, the thickness of the shearwall 14 will be the sum of the width of the protrusion 22A and the width of a pair of slab panels 34A.

Still referring to FIG. 3, according to another embodiment of the present invention, the first and second columns 18A and 20A are designed to include a recess portion 46A on the respective connecting ends 24A and 26A of the concrete columns 18A and 20A. Each recess portion 46A has two side surfaces 48A and 50A and a center surface 52A. A pair of horizontal slab panels 34A are positioned between the respective recess portions 46A of first and second concrete columns 18A and 20A and abutting the two side surfaces 48A and 50A of the respective recess portions 46A. A plurality of trusses 40A (e.g. girder trusses) are attached to inner surfaces of the of horizontal slab panels 34A. Trusses 40A are used to facilitate easy pick up and transportation of the slab panels 34. A horizontal reinforcement 54A extends between the respective recess portions 46A of the first and second columns 18A and 20A and between the respective trusses 40A attached to the inner surfaces of the pair of horizontal slab panels 34A. One or more vertical reinforcement 58A can also extend between the inner surfaces of the pair of horizontal slab panels 34A. Lap splices are used as needed according to American Concrete Institute (ACI) codes. In the depicted embodiment, there is a gap 36A between the end of the respective slab panels 34A and the respective center surfaces 52A of the respective recess portions 46A. Concrete is poured into the volume 56A formed between the pair of horizontal slab panels 28 and the first and second concrete columns 18A and 20A. Gap 36A will ensure a robust connection between adjacent structures.

Figure 4:
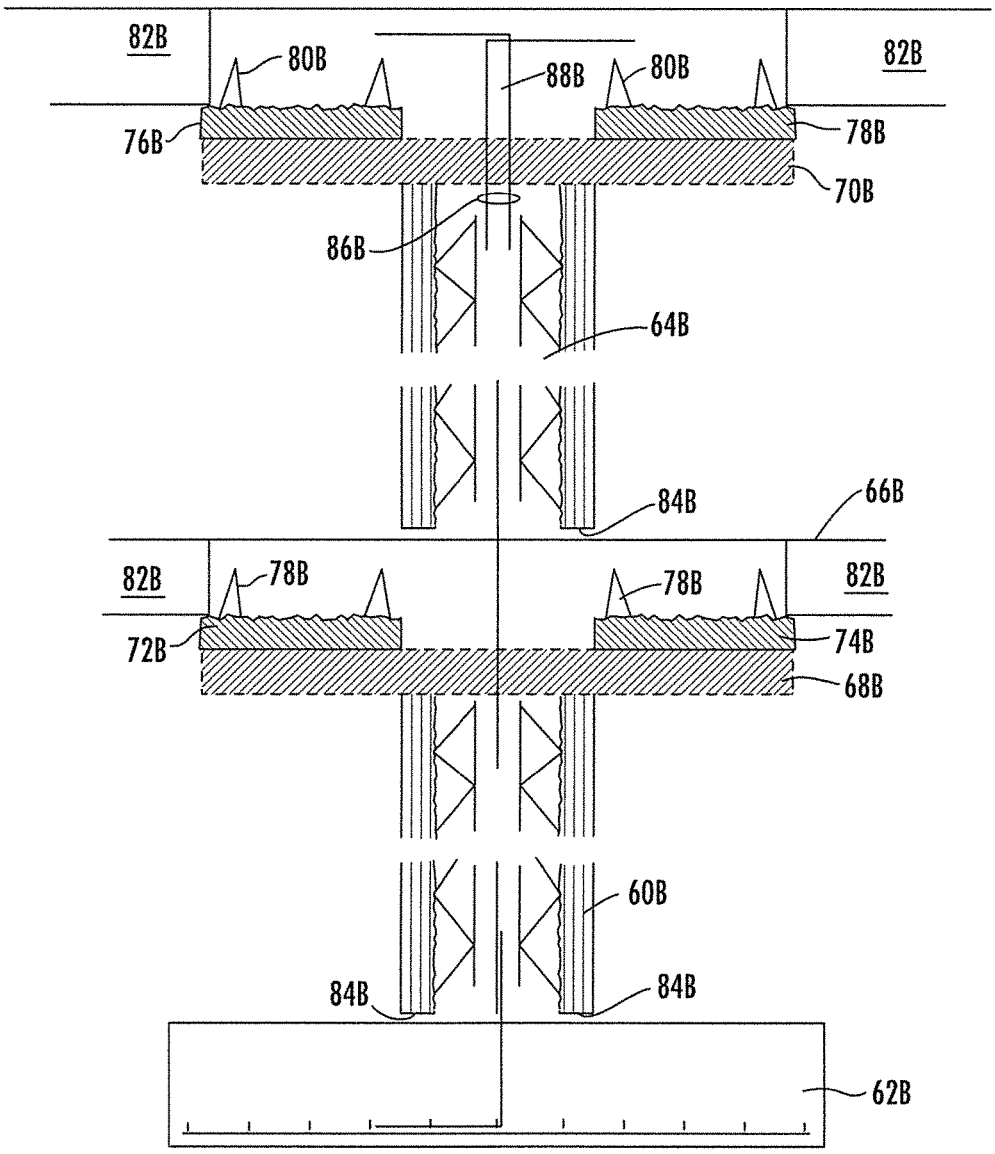
FIG. 4 is a cross-sectional view of a shearwall assembly along line B-B' of FIG. 1, according to one embodiment of the present invention.

Referring to FIG. 4, a cross-sectional view of a shearwall assembly along lines B-B' of a multi-level concrete construction of FIG. 1 is shown. A first-level shearwall 60B is built on a concrete footing 62B and a second-level shearwall 64B is built between a second-level floor 66B supported by a second-level column capital (e.g. column capital 68B) and a third-level column capital (e.g. column capital 70B). Each shearwall assembly is built in the manner as described in FIG. 2 or FIG. 3.

In the depicted embodiment, respective beams 72B, 74B, 76B and 78B are positioned on the respective column capitals 68B and 70B with respective trusses 80B attached thereto. Respective floor slabs 82B are positioned at the edges of the respective beams (e.g., beams 72B, 74B, 76B and 78B) and connected to the column capitals at different rows (not shown). There is a gap 84B between a shearwall and its underlying surface (e.g., concrete footing 62B, second-level floor 666). One or more rigid panels (not shown) can be temporarily used to seal the gap 84B when concrete is poured into the empty volume of a shearwall. The rigid panels are removed when the concrete has cured. This will ensure that the shearwalls are firmly connected to the respective underlying surface and achieve composite action there between. The construction of concrete shearwall assembly and other related structure are performed according to American Concrete Institute protocol.

In the depicted embodiment, horizontal reinforcements and vertical reinforcements are used to provide further reinforcement of the concrete structure. For example, one or more horizontal rebars 86B extend between the respective concrete columns of the shearwalls. One or more vertical rebars 88B extend vertically and continuously from the bottom of concrete footing 62B through the second and third floor of column capitals (e.g., 66B and 70B). The horizontal and vertical rebar structures may be composed of multiple unit sections spliced together. Alternatively, the sections may be connected by lap joints, welding, or other conventional methods.

Figure 5:
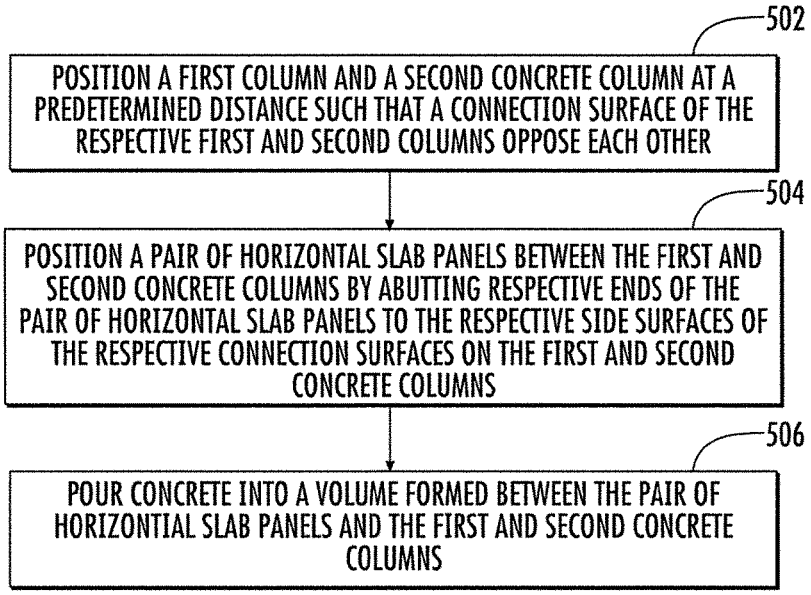
FIG. 5 is a flow chart illustrating a method of making a shearwall assembly.

Referring to FIG. 5, according to a method aspect of the present invention, a method of making a shearwall assembly includes, at step 502, positioning a first and a second concrete column (e.g., column 18 and column 20) at a predetermined distance such that a connection surface of the first column opposes a connection surface of the second column. The connection surface can be a protrusion surface such as protrusion 22, as shown in FIG. 2, or a recession surface such as the recession portion 46A, as shown in FIG. 3. The connection surface has two side surfaces, for example, side surfaces 28 and 30 of the protrusion 22 or side surfaces 48A and 50A of the recession portion 46A.

At step 504, a pair of horizontal slab panels (e.g., horizontal slab panels 34) are positioned between the first and second concrete columns (e.g., column 18 and 20) by abutting respective ends of the pair of horizontal slab panels to the side surfaces of the respective connection surfaces (e.g., see, FIG. 2, FIG. 3). A volume is thus formed between the pair of horizontal slab panels and the first and second concrete columns. At least one horizontal reinforcement (e.g., horizontal reinforcement 38 or 54A) is attached between the respective connection surfaces of the first and second columns 18 and 20. The inner surfaces of the pair of horizontal slab panels are roughen according to American Concrete Institute (ACI) code protocol. A plurality of trusses (e.g., girder trusses 40) can be attached to inner surfaces of the pair of horizontal slab panels.

At step 506, concrete is poured into the volume formed between the pair of horizontal slab panels and the first and second concrete columns 18 and 20. A shearwall assembly is thus formed between the pair of horizontal slab panels and the first and second concrete columns 18 and 20.

The disclosed shearwall will provide increased stability to a construction system. The dimension of the shearwall can readily be adjusted by altering the length of the protrusion 22 or recess portion 46A. The method as disclosed here can produce more robust shearwalls and ensure accurate final alignment and placement of the structural elements. The present invention can significantly increase the stability and strength of the concrete construction system. The shearwall may be installed in any desired directions. For example, two sets of shearwalls can be installed perpendicular to each other.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A shearwall assembly comprising:

a floor;

a first concrete column and a second concrete column extending upwardly from the floor with a first column face of the first column facing a second column face of the second column, a first protrusion and second protrusion extending from the first column face and the second column face, respectively, and;

a first column capital and a second column capital arranged at upper ends of the first and second columns, respectively;

a pair of horizontal slab panels positioned between the first and second precast concrete columns, each of the pair of horizontal slab panels extending in a length direction between first and second panel ends and in a height direction between upper and lower panel edges, the first and second panel ends of each of the pair of horizontal slab panels extending toward the first and second column faces, respectively, and abutting opposite sides of the first and second protrusions, end gaps being defined between adjacent ones of the first and second column faces and the first and second panel ends, and lower edge gaps being defined between the lower edges and the floor, the upper edges extending up to the first and second column capitals, and each of the pair of horizontal slab panels having roughened inner faces; and poured concrete at a volume formed between the pair of horizontal slab panels and the first and second precast concrete columns and filling the end gaps and lower edge gaps;

wherein a respective horizontal reinforcement extends from the first and second protrusions; and wherein a plurality of trusses extend from the roughened inner faces of the pair of horizontal slab panels such that the horizontal reinforcements extending from the first and second protrusions are fitted between the respective trusses within the volume embedded in the poured concrete.

2. The assembly of claim 1, wherein the horizontal reinforcement is a steel rebar.

3. The assembly of claim 1, further comprising a vertical reinforcement extending in perpendicular to the respective horizontal reinforcements within the volume.

4. A shearwall assembly comprising:

a floor;

a first and a second concrete column extending upwardly from the floor with a first column face of the first column facing a second column face of the second column, a first recess formed extending into the first column face and a second recess formed extending into the second column face, each of the first and second recesses having a center face and opposite sides;

a first column capital and a second column capital arranged at upper ends of the first and second columns, respectively;

a pair of horizontal slab panels positioned between the first and second concrete columns, each of the pair of horizontal slab panels extending in a length direction between first and second panel ends and in a height direction between upper and lower panel edges, the first and second panel ends of each of the pair of horizontal slab panels extending toward the first and second column faces, respectively, and abutting the opposite sides of the first and second recesses, end gaps being defined between adjacent ones of the center faces of the first and second recesses and the first and second panel ends, and lower edge gaps being defined between the lower edges and the floor, the upper edges extending up to the first and second column capitals, and each of the pair of horizontal slab panels having roughened inner faces; and poured concrete at a volume formed between the pair of horizontal slab panels and the first and second concrete columns; and a horizontal reinforcement extending from the first and second recesses; and wherein a plurality of trusses extend from the roughened inner faces of the pair of horizontal slab panels such that the horizontal reinforcements extending from the first and second recesses are fitted between the respective trusses within the volume embedded in the poured concrete.

5. The assembly of claim 4, wherein the horizontal reinforcement is a steel rebar.

6. The assembly of claim 4, further comprising at least one vertical reinforcement extending perpendicularly to the horizontal reinforcement within the volume.

* * * * *